US007502486B2

(12) United States Patent
Shin et al.

(10) Patent No.: US 7,502,486 B2
(45) Date of Patent: Mar. 10, 2009

(54) PLANE SPEAKER HAVING COIL PLATE GUIDE DEVICE

(76) Inventors: Joung-Youl Shin, Samsung Remian Apt. 103-1804, 414, Naeson-Dong, Uiwang 437-804 (KR); Byung-Wan Han, 401, Wooran Billa, 1478-4 Seocho3-Dong, Seocho-Gu, Seoul 137-868 (KR)

( * ) Notice: Subject to any disclaimer, the term of this patent is extended or adjusted under 35 U.S.C. 154(b) by 212 days.

(21) Appl. No.: 10/596,213

(22) PCT Filed: Dec. 2, 2004

(86) PCT No.: PCT/KR2004/003156

§ 371 (c)(1),
(2), (4) Date: Jun. 2, 2006

(87) PCT Pub. No.: WO2005/055648

PCT Pub. Date: Jun. 16, 2005

(65) Prior Publication Data

US 2007/0076915 A1 Apr. 5, 2007

(30) Foreign Application Priority Data

Dec. 5, 2003 (KR) ..... 10-2003-0088157

(51) Int. Cl.
*H04R 25/00* (2006.01)

(52) U.S. Cl. ..... 381/396; 381/408; 381/431

(58) Field of Classification Search ..... 381/190, 381/191, 398, 399, 400, 401, 403, 404, 408, 381/431, 433, 417, 418, 176, 407, 423; 181/171, 181/172

See application file for complete search history.

(56) References Cited

U.S. PATENT DOCUMENTS 4,190,746 A * 2/1980 Harwood et al. ..... 381/427
5,604,815 A * 2/1997 Paddock ..... 381/396
6,438,246 B1 8/2002 Kim

FOREIGN PATENT DOCUMENTS

JP 04-329100 11/1992

* cited by examiner

*Primary Examiner*—Huyen D Le
(74) *Attorney, Agent, or Firm*—IPLA P.A.; James E. Bame

(57) ABSTRACT

The present invention relates to a plate type speaker with a planar diaphragm. The plate type speaker of the present invention comprises a base frame; at least one magnetic body coupled to the base frame such that opposite polarities are provided at adjacent lateral positions and are spaced apart by a predetermined distance from each other; a diaphragm; at least one coil plate that is formed with a voice coil wound on either or both of sides thereof, and is inserted vertically into spaces between the opposite polarities of the magnetic body and connected to the diaphragm; and a coil plate guide means coupled to the coil plate for guiding the position and vibration direction of the coil plate such that the coil plate is spaced from the magnetic bodies and vibrates vertically. The use of the plate type speaker with the coil plate guide means according to the present invention allows the position of a coil plate to be guided so that the coil plate does not come into contact with a permanent magnet or upper and lower plates even though the coil plate vibrates vertically, thereby preventing output of abnormal sound due to interference of the coil plate with the internal parts.

9 Claims, 16 Drawing Sheets

【Fig. 1】
Prior Art
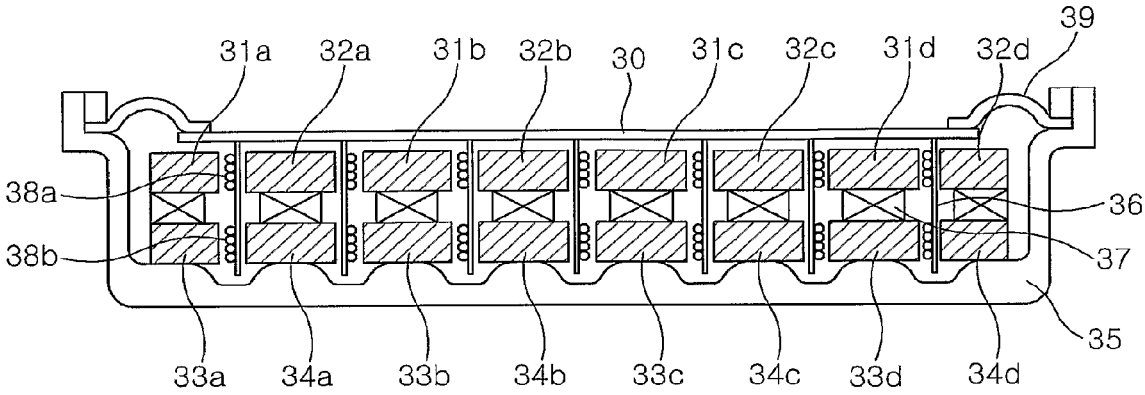

【Fig. 2】
Prior Art
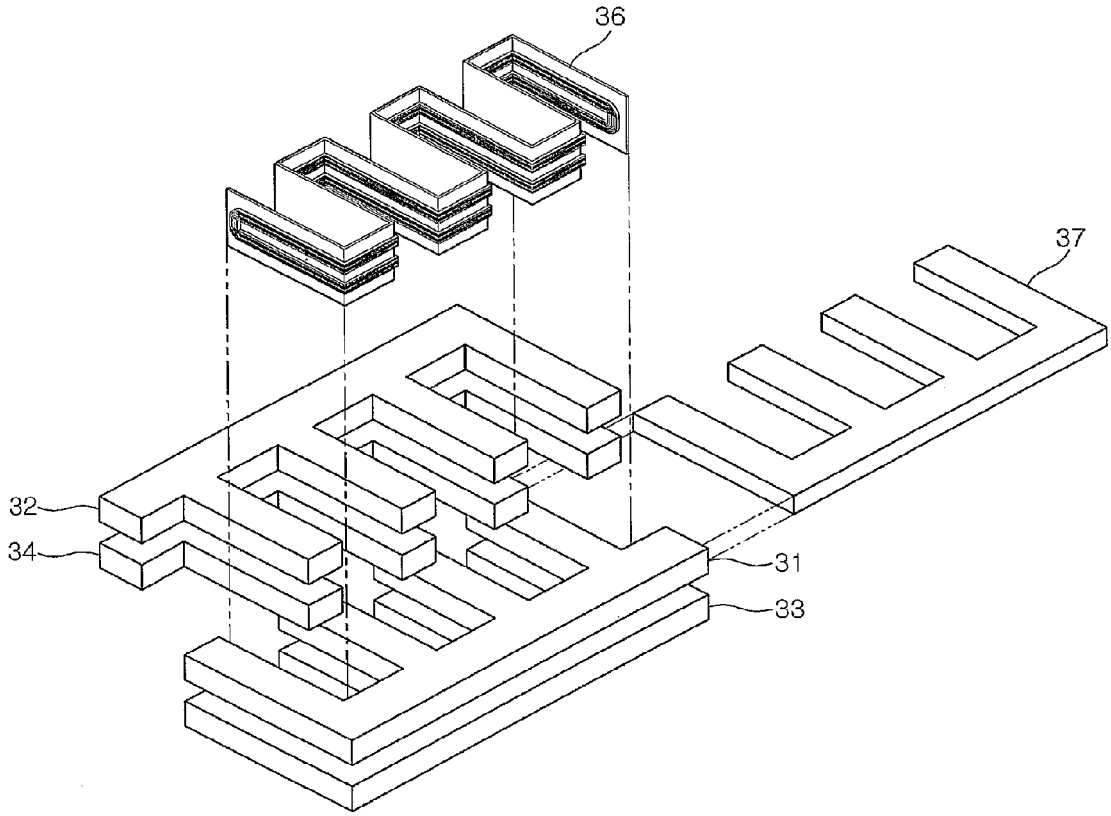

【Fig. 3】
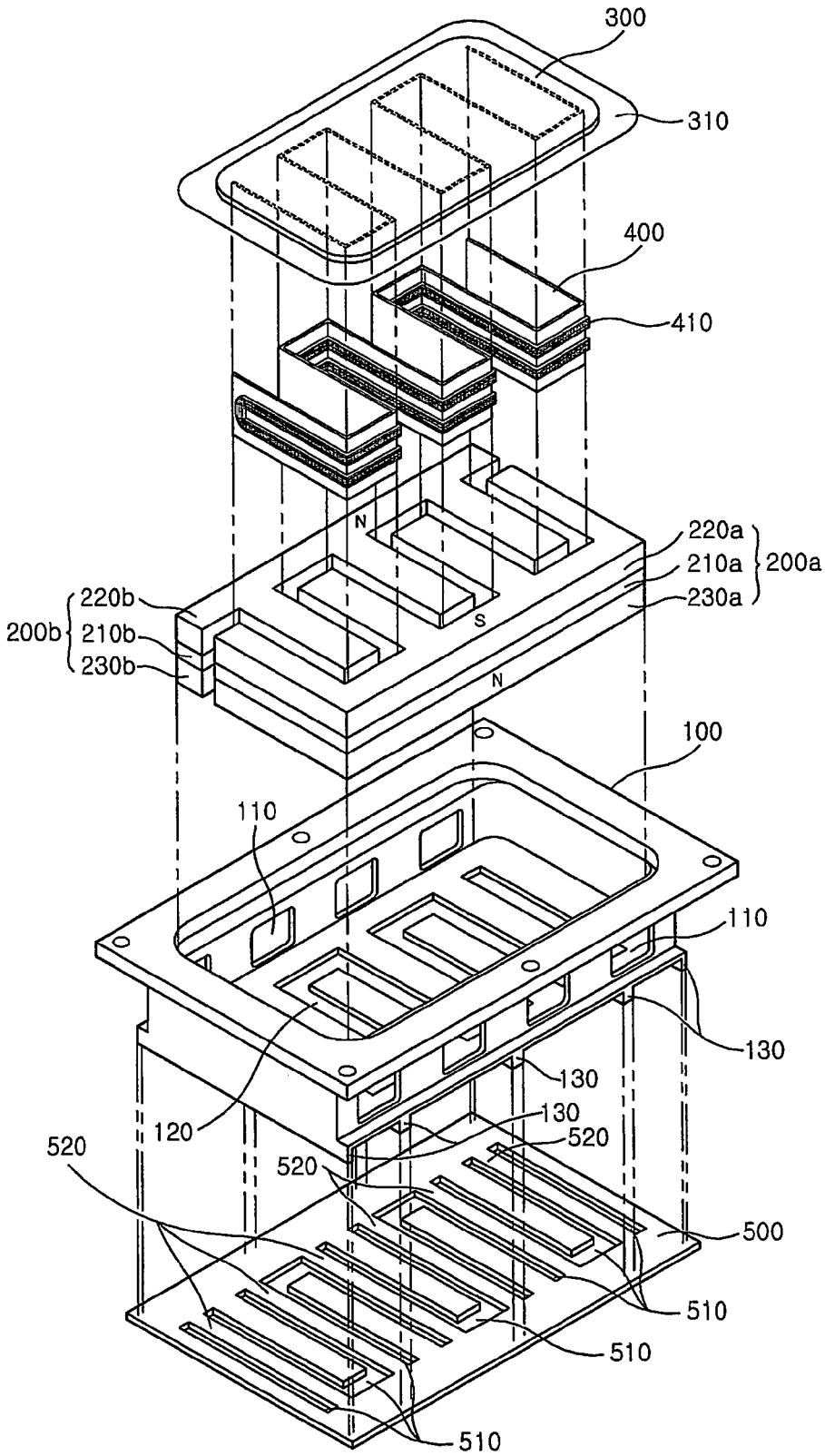

【Fig. 4】
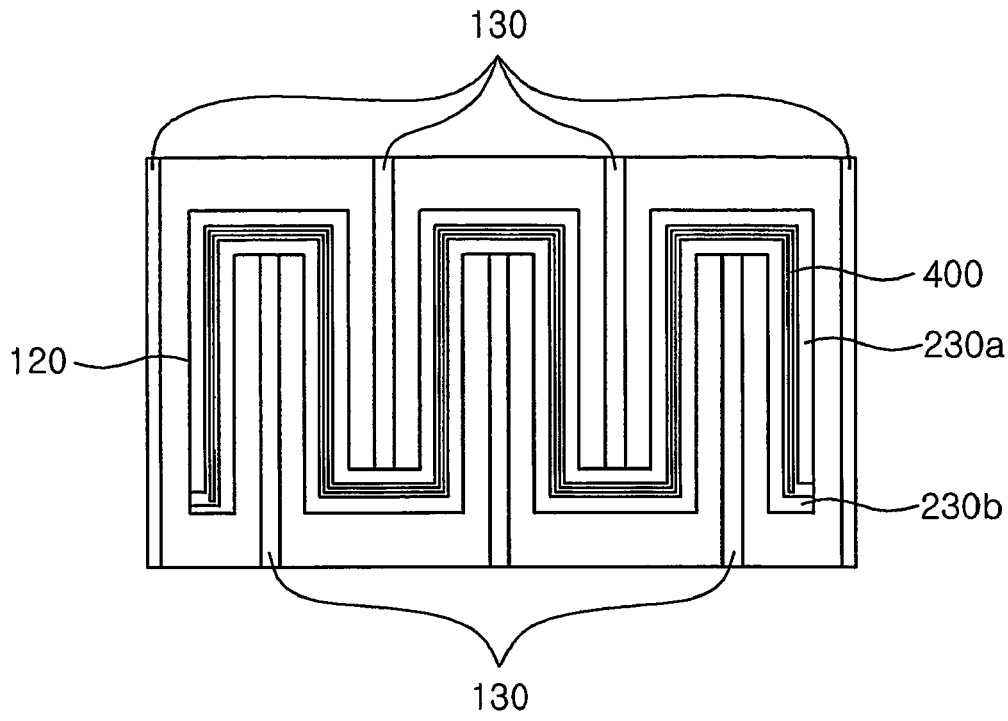
【Fig. 5】
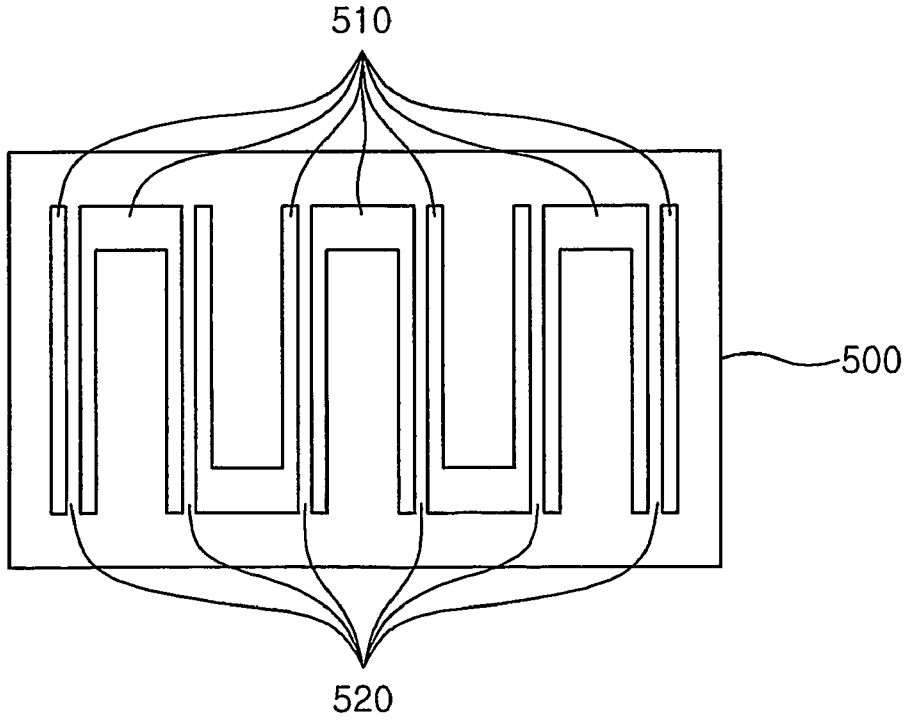

【Fig. 6】
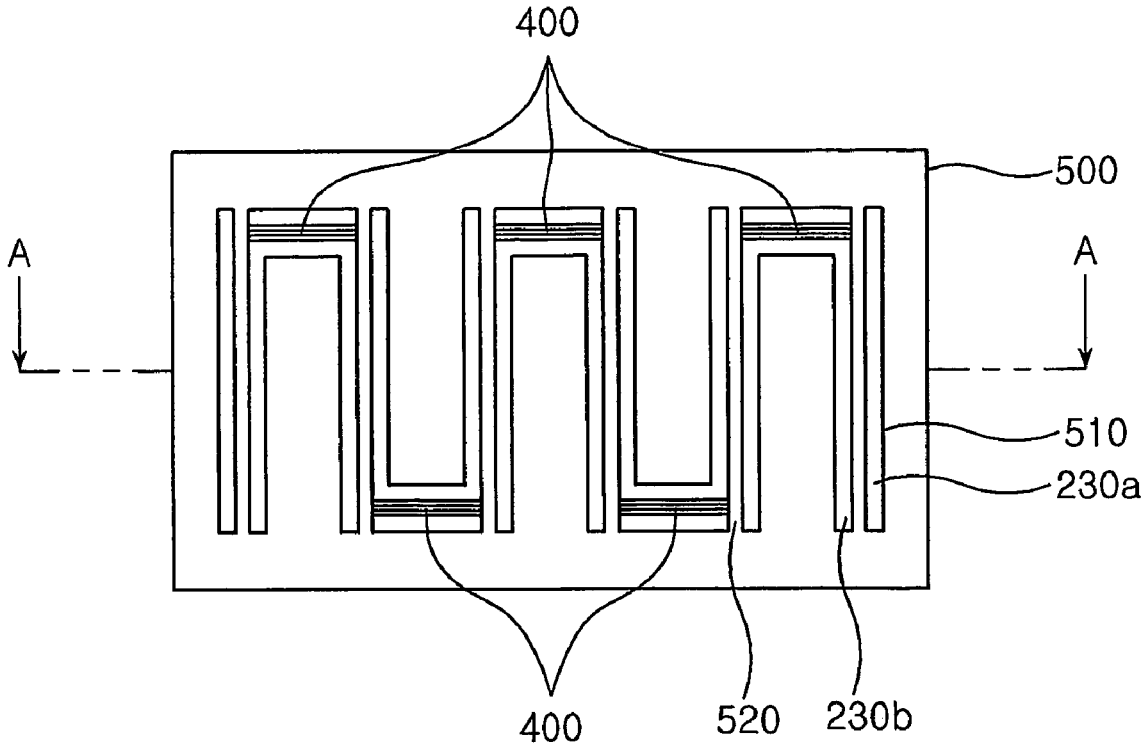

【Fig. 7】
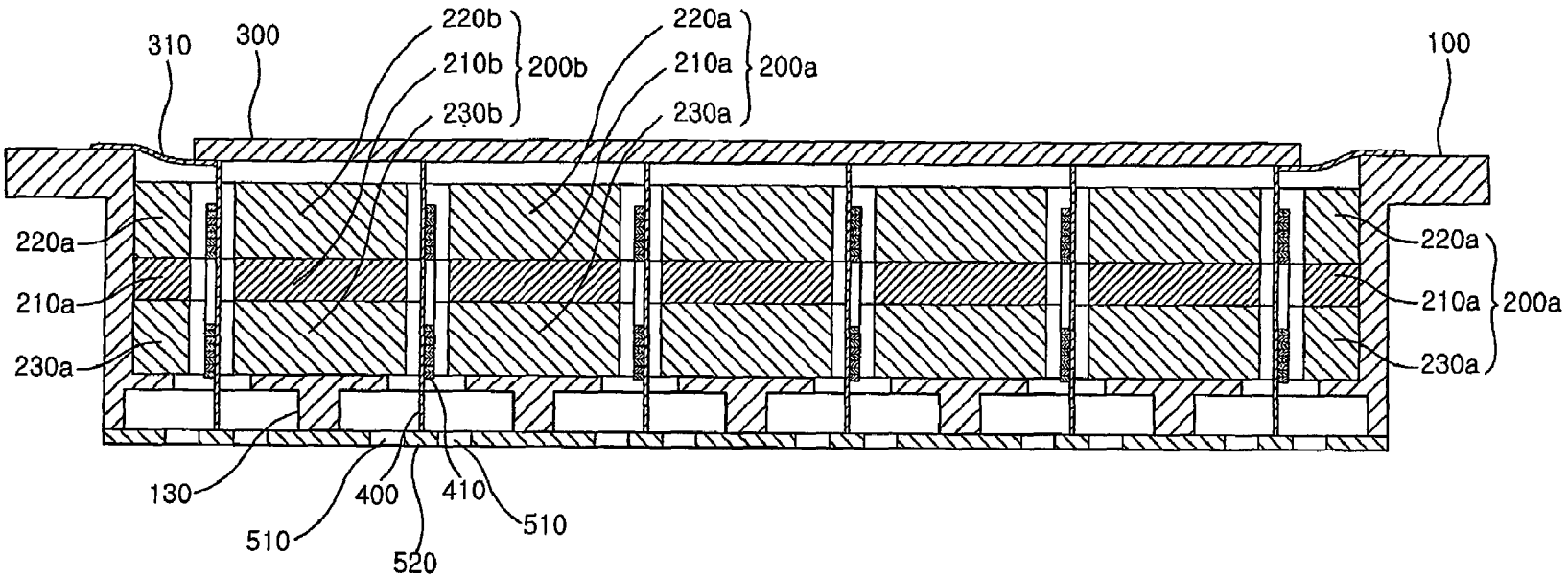

【Fig. 8】
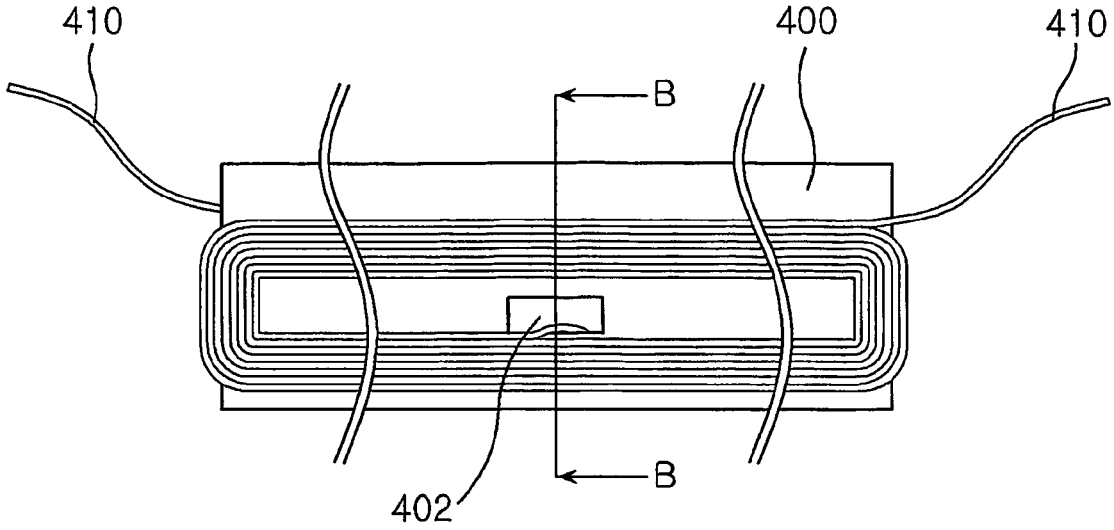
【Fig. 9】
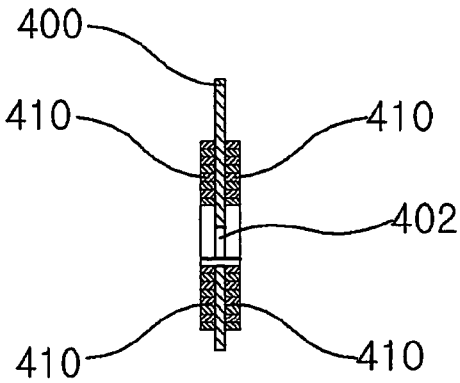

【Fig. 10】
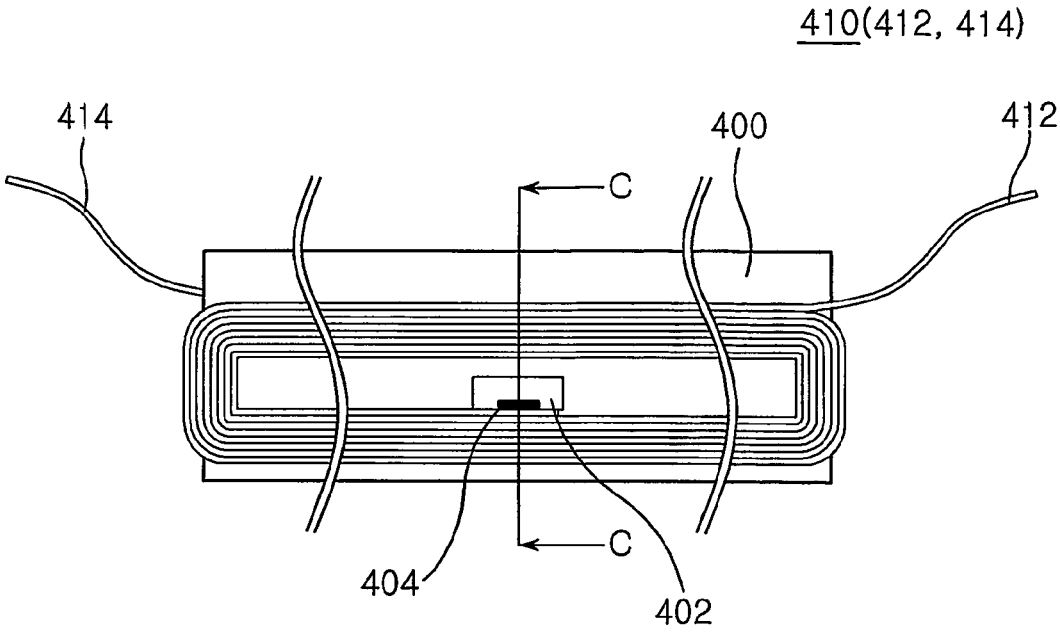
【Fig. 11】
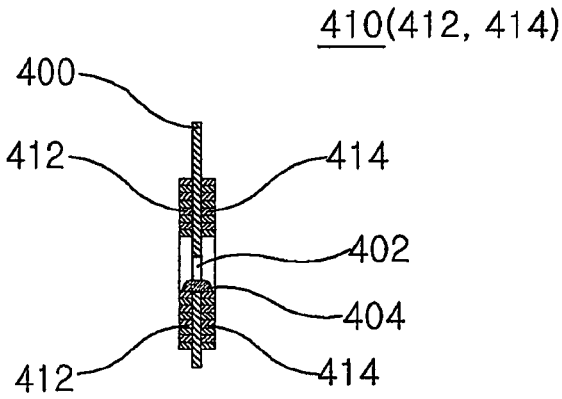

【Fig. 12】
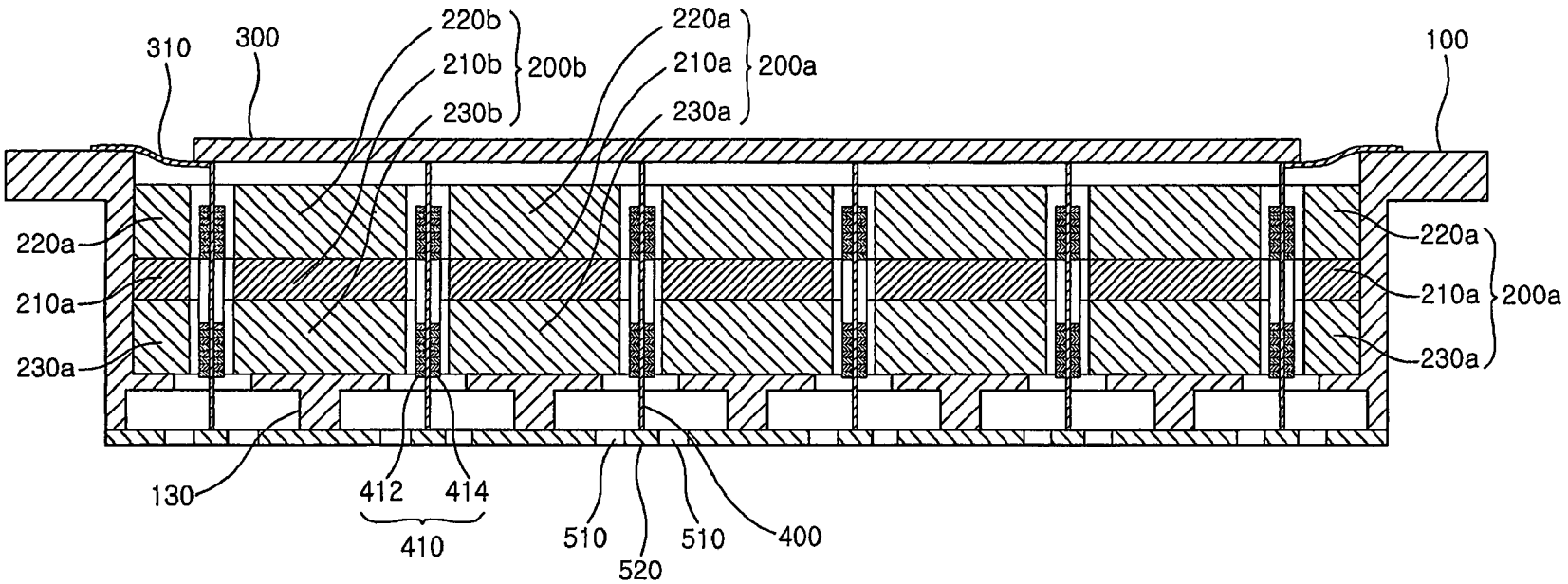

【Fig. 13】
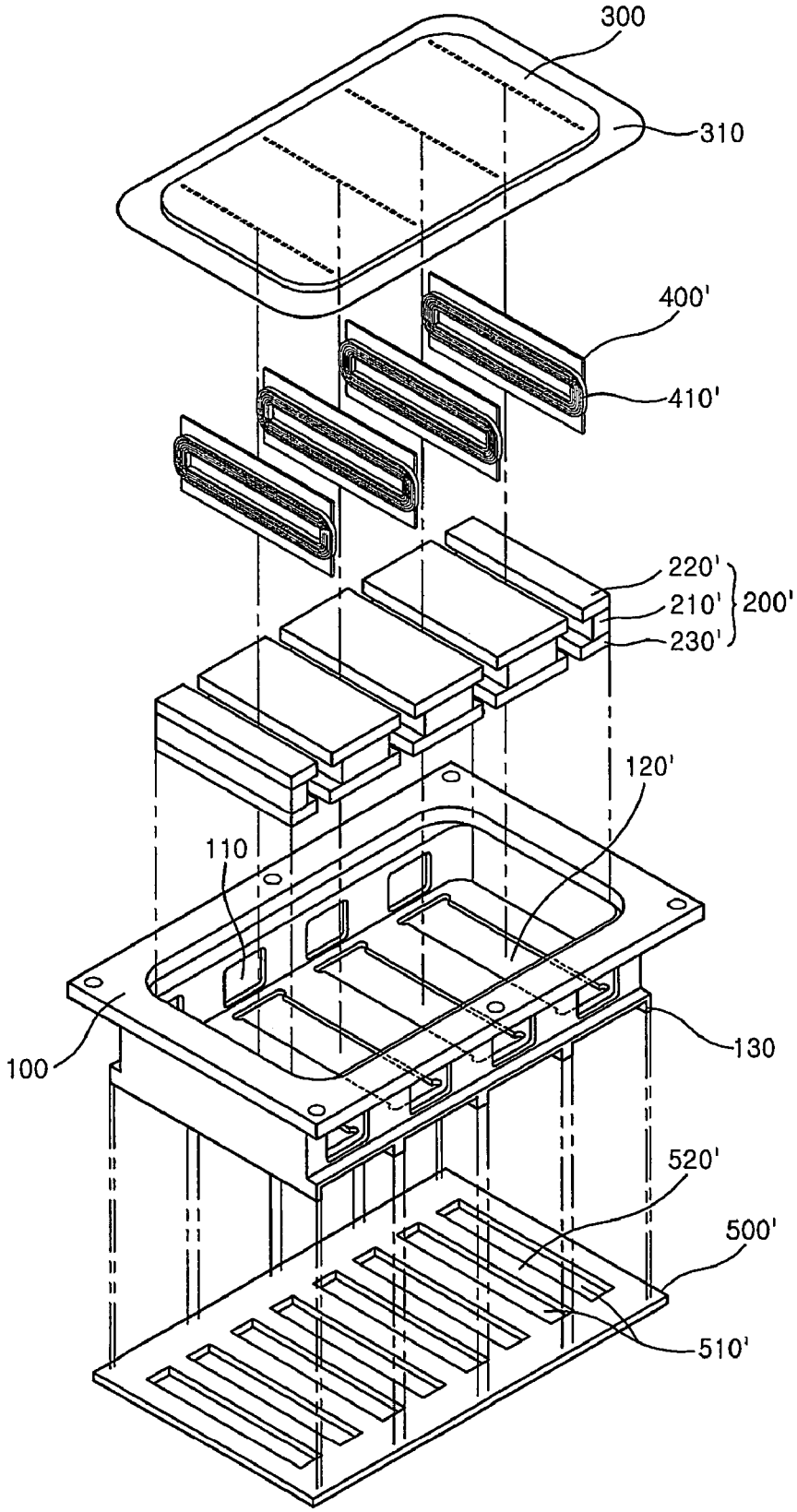

【Fig. 14】
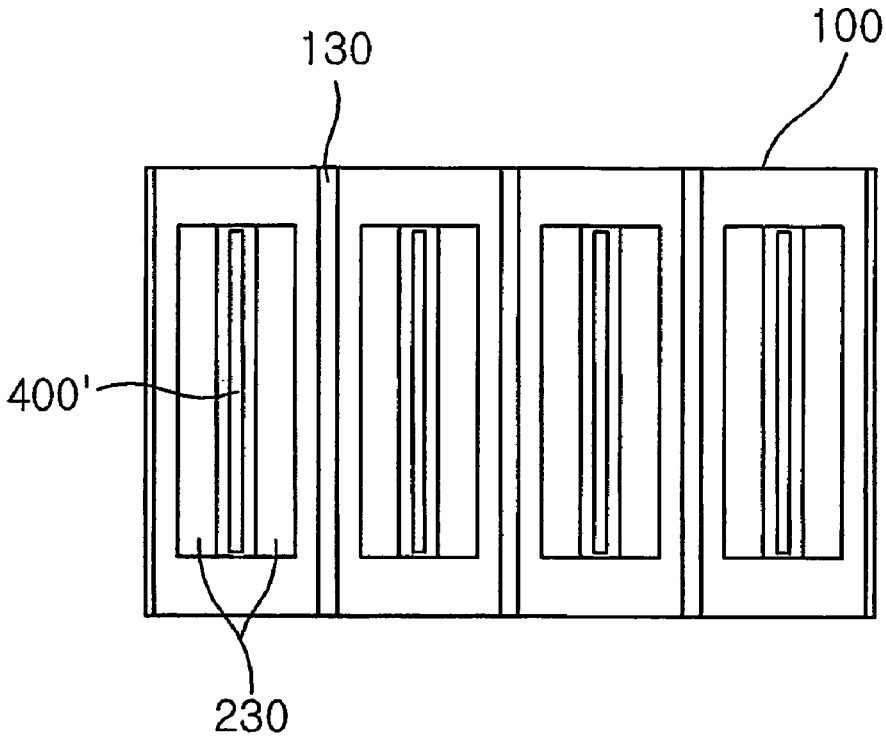
【Fig. 15】
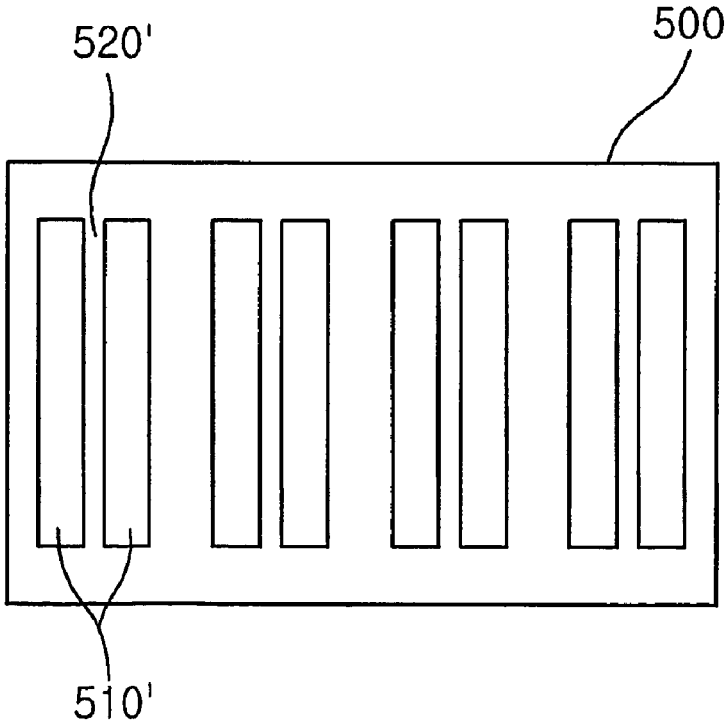

【Fig. 16】
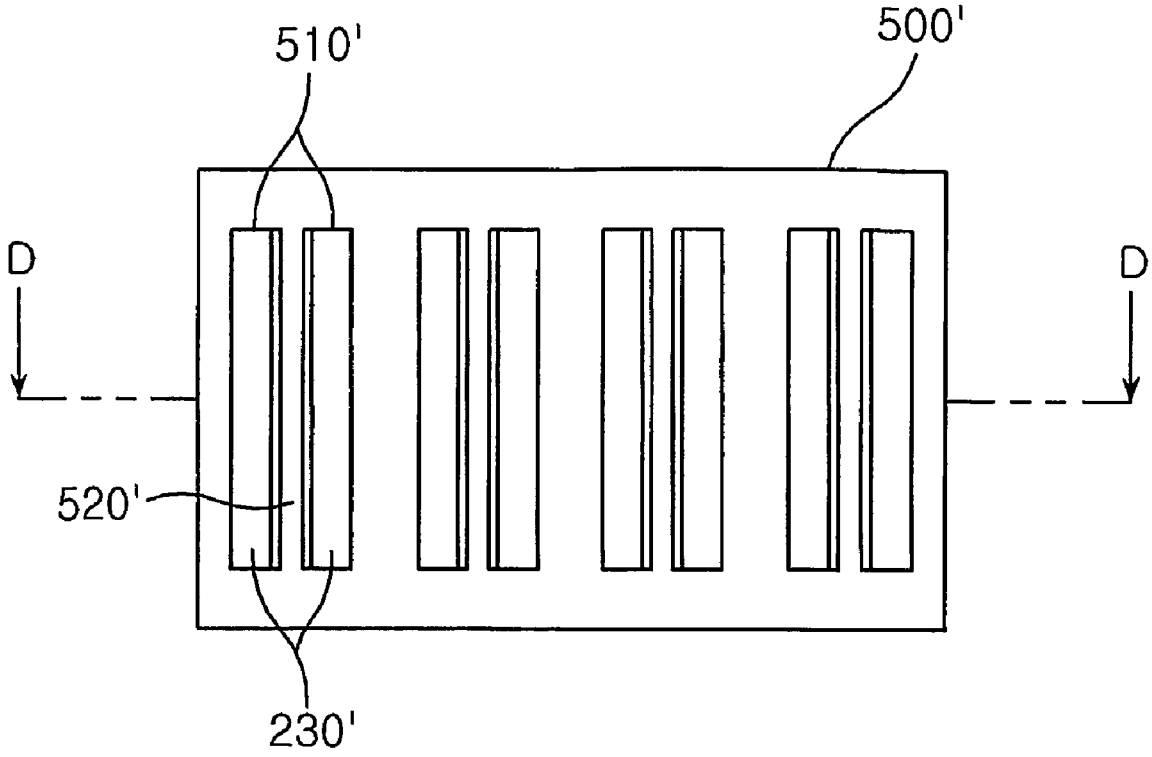

【Fig. 17】
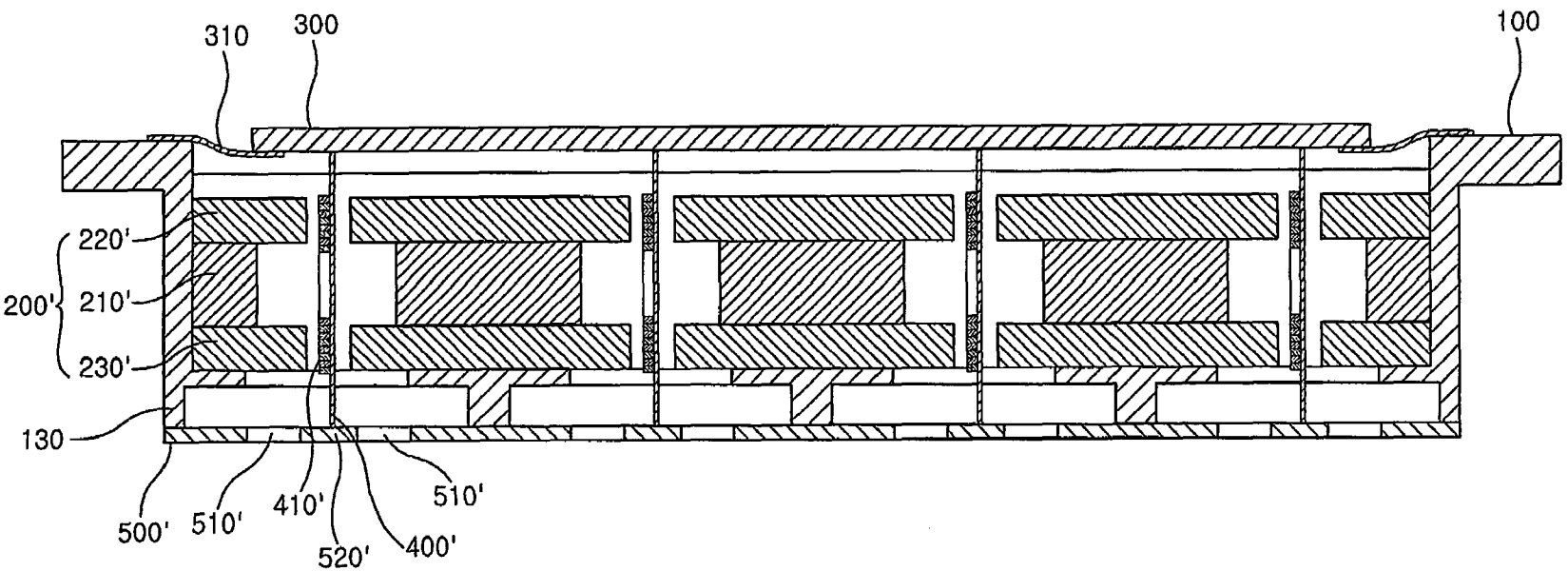

【Fig. 18】
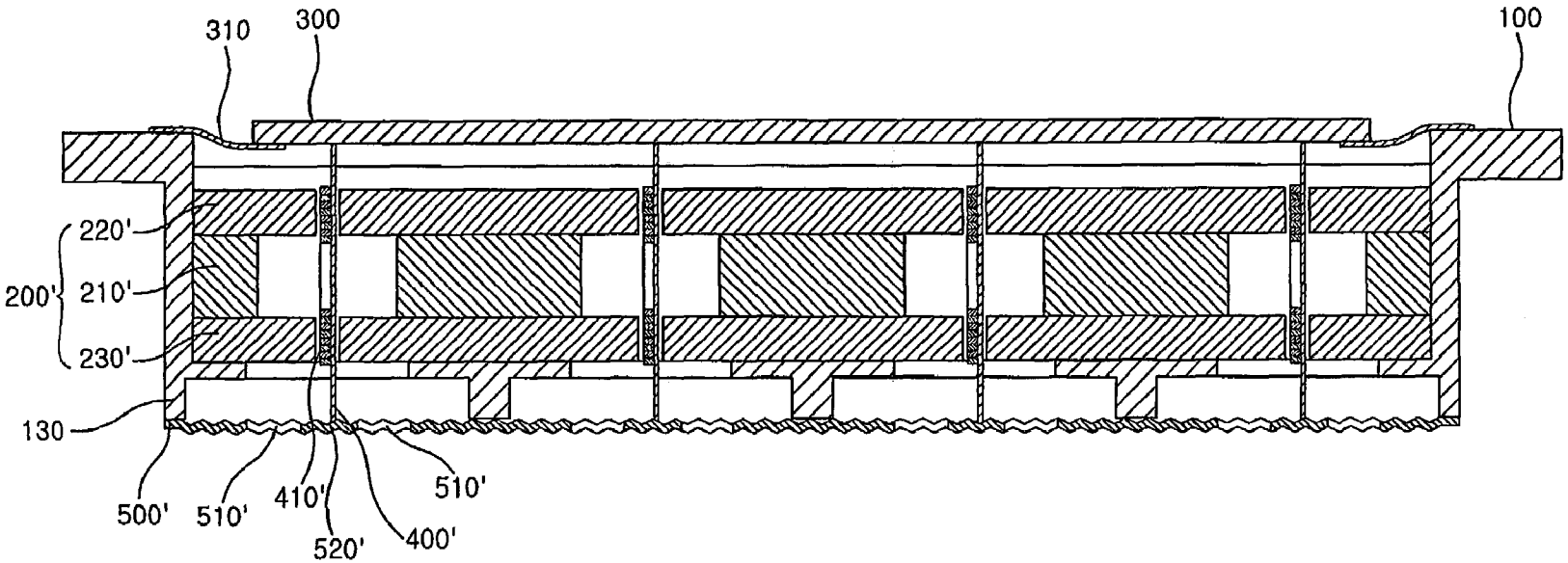

【Fig. 19】
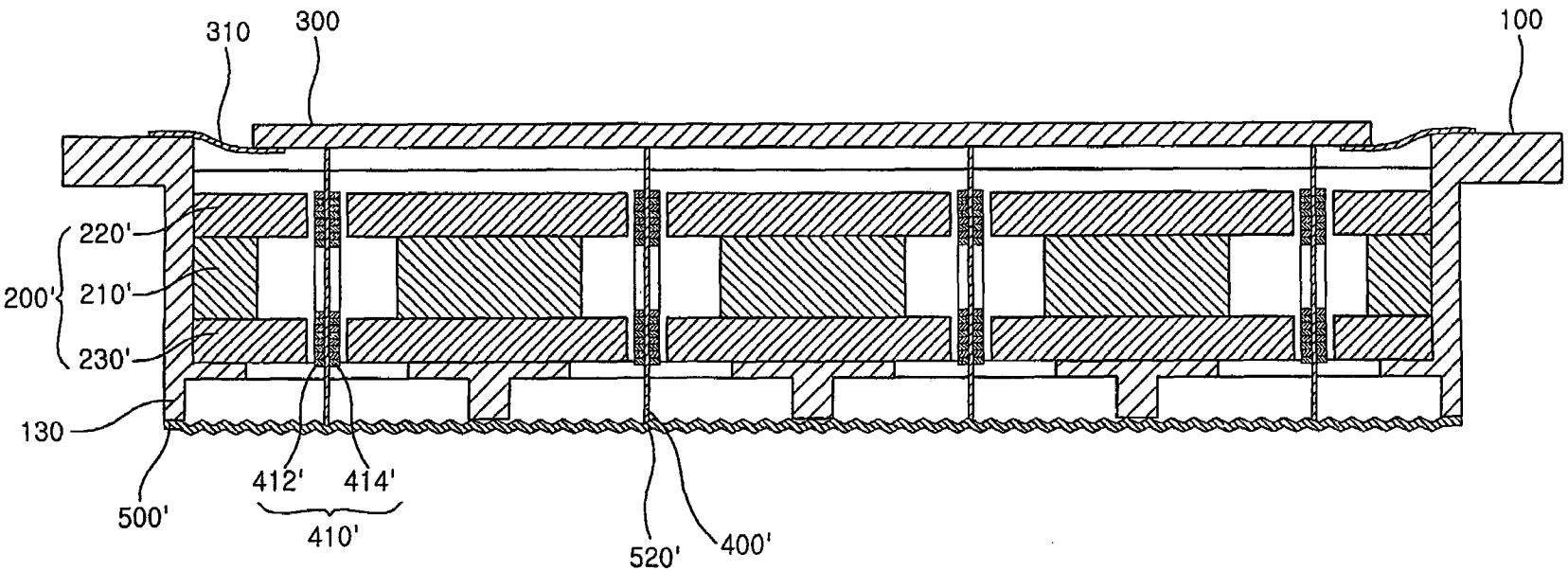

【Fig. 20】
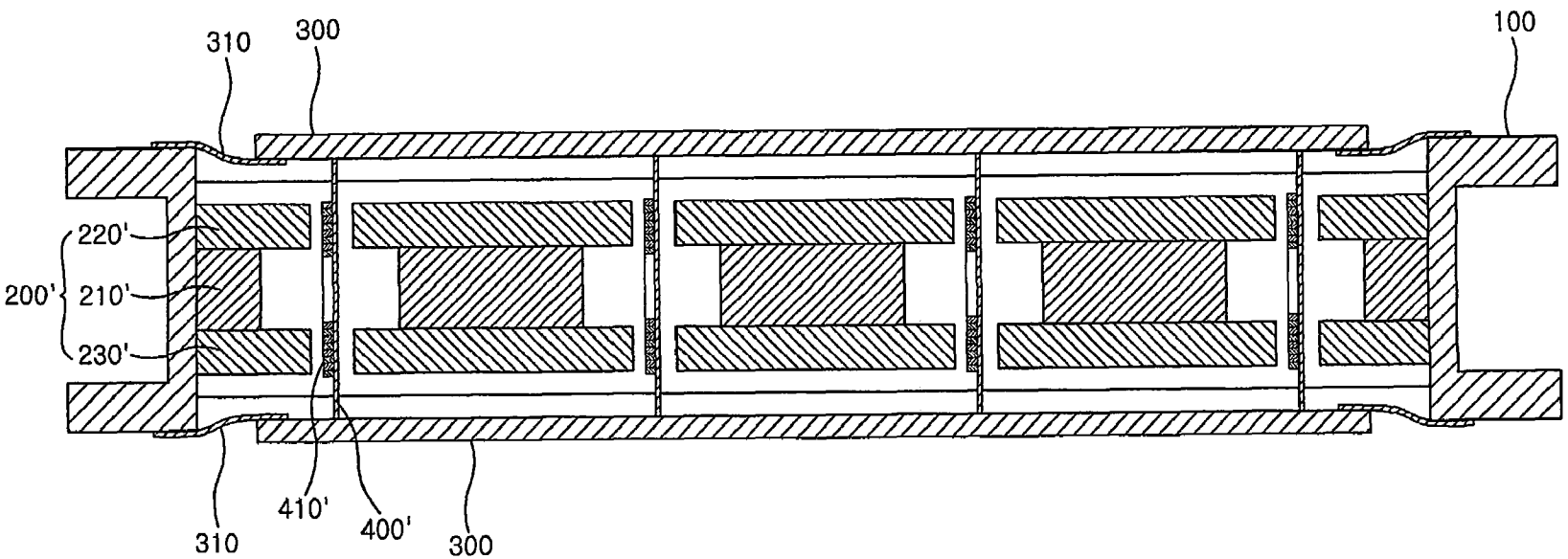

PLANE SPEAKER HAVING COIL PLATE GUIDE DEVICE

TECHNICAL FIELD

The present invention relates to a plate speaker with a planar diaphragm, and more particularly, to a plate speaker constructed to guide a vibration direction of a coil plate such that the coil plate does not come into contact with permanent magnets and/or upper and lower plates.

BACKGROUND ART

A conventional plate type speaker will be described with reference to the accompanying drawings.

FIG. 1 is a schematic sectional view of a conventional plate type speaker, and FIG. 2 is an exploded perspective view of a coupling structure of a voice coil, permanent magnets and plates employed in the conventional plate type speaker.

As shown in FIGS. 1 and 2, a flat coil plate 36 with a top end to which a flat diaphragm 30 is vertically fixed is inserted into an assembly of upper plates 31*a*, 31*b*, 31*c*, 31*d*, 32*a*, 32*b*, 32*c* and 32*d*, lower plates 33*a*, 33*b*, 33*c*, 33*d*, 34*a*, 34*b*, 34*c* and 34*d* and permanent magnets 37 fixed therebetween. The assembly of permanent magnets and upper and lower plates is fixed to a base frame 35. Then, an edge 39 is bonded to the periphery of the flat diaphragm 30 and secured by a guide ring.

An electric current generated at a speaker driving circuit is supplied to a voice coil 38 fixed at the coil plate 36 to produce a magnetic field at the voice coil 38. The magnetic field cooperates with a facing magnetic field generated from the polarity of the permanent magnet-plate assembly, thereby generating a force that vibrates the coil plate 36 and the flat diaphragm 30 fixed thereto. Consequently, the vibration of the diaphragm 30 causes sound to radiate outside.

At this time, the coil plate 36 is kept in non-contact with the upper and lower plates 31 to 34 not to interfere with the vibration of the planar diaphragm 30 and is connected to the permanent magnets 37 as close as possible so that the coil plate can be much influenced by the magnetic field.

However, in the conventional plate type speaker constructed as above, there is difficulty in manufacturing the plate type speaker in that the coil plate 36 should be bent according to the shapes of spaces between the upper plates 31 and 32 and between the lower plates 33 and 34.

Further, if the coupling direction or shape of the coil plate 36 is changed due to long-time use of the speaker, there is a problem in that the coil plate 36 comes into contact with the upper and lower plates 31 to 34, resulting in abnormal vibration of the diaphragm 30.

DISCLOSURE

Technical Problem

The present invention is conceived to solve the aforementioned problems. An object of the present invention is to provide a plate type speaker with a coil plate guide means for restricting the vibration direction and position of a coil plate such that the coil plate does not come into contact with permanent magnets and/or upper and lower plates.

Technical Solution

According to the present invention for achieving the object, there is provided a plate type speaker, comprising a base frame; at least one magnetic body coupled to the base frame such that opposite polarities are provided at adjacent lateral positions and are spaced apart by a predetermined distance from each other; a diaphragm; at least one coil plate that is formed with a voice coil wound on either or both of sides thereof, and is inserted vertically into spaces between the opposite polarities of the magnetic body and connected to the diaphragm; and a coil plate guide means coupled to the coil plate for guiding the position and vibration direction of the coil plate such that the coil plate is spaced from the magnetic bodies and vibrates vertically.

The base frame may be configured to have open top and bottom portions, the diaphragm may be coupled to an upper end of the coil plate, and the coil plate guide means may be coupled to a lower end of the coil plate to function as another diaphragm.

Alternatively, the base frame may have at least one opening formed in at least a portion of a bottom surface thereof corresponding to a lower end of the coil plate so that the lower end of the coil plate passes through the bottom surface of the base frame, and the coil plate guide means may comprise a fixing member formed to be flexible and coupled to the lower end of the coil plate and to the bottom surface of the base frame. In this case, the fixing member is preferably corrugated to have ridges and troughs along a longitudinal direction of the coil plate. Further, the fixing member may be formed with through-holes.

Preferably, a plurality of the magnetic bodies with opposite polarities at upper and lower ends thereof are spaced apart by a predetermined distance from one another. At this time, each of the magnetic bodies preferably comprises a permanent magnet with opposite polarities at upper and lower ends thereof; an upper plate connected to the upper end of the permanent magnet; and a lower plate connected to the lower end of the permanent magnet and connected to a bottom surface of the base frame. In this case, both opposite ends of the voice coil wound on either or both of the sides of the coil plate may be positioned at levels of the upper and lower ends of the magnetic bodies, respectively.

The base frame may be formed with at least one opening bored through a wall surface thereof.

The magnetic body may be formed to take the shape of a comb such that respective portions of the magnetic body with the opposite polarities have protrusions and depressions in a horizontal direction, the protrusions are inserted into the respective depressions with a predetermined gap therebetween, and the coil plate is formed to take the shape of a plate bent such that it can be vertically inserted into the spaces.

A plurality of coil plates in the form of a flat panel may be arranged in parallel.

BRIEF DESCRIPTION OF DRAWINGS

FIG. 1 is a schematic sectional view of a conventional plate type speaker.

FIG. 2 is an exploded perspective view of a coupling structure of a voice coil, permanent magnets and plates employed in the conventional plate type speaker.

FIG. 3 is an exploded perspective view of a plate type speaker according to a first embodiment of the present invention.

FIG. 4 is a bottom view of a base frame to which a coil plate and magnetic bodies shown in FIG. 3 are coupled.

FIG. 5 is a plan view of a fixing member shown in FIG. 3.

FIG. 6 is a bottom view of the plate type speaker according to the first embodiment of the present invention.

FIG. 7 is a sectional view of the plate type speaker, taken along line A-A of FIG. 6.

FIG. 8 illustrates a state where a voice coil is coupled to front and rear surfaces of a coil plate.

FIG. 9 is a sectional view taken along line B-B of FIG. 8.

FIG. 10 illustrates a state where front and rear voice coils are coupled to front and rear surfaces of a coil plate, respectively.

FIG. 11 is a sectional view taken along line C-C of FIG. 10.

FIG. 12 is a sectional view of a plate type speaker with front and rear voice coils coupled to front and rear surfaces of a coil plate, respectively, according to the present invention.

FIG. 13 is an exploded perspective view of a plate type speaker according to a second embodiment of the present invention.

FIG. 14 is a bottom view of a base frame to which coil plates and magnetic bodies shown in FIG. 13 are coupled.

FIG. 15 is a plan view of a fixing member shown in FIG. 13.

FIG. 16 is a bottom view of the plate type speaker according to the second embodiment of the present invention.

FIG. 17 is a sectional view of the plate type speaker, taken along line B-B of FIG. 16.

FIG. 18 illustrates an application of a corrugated fixing member.

FIG. 19 is a sectional view of a plate type speaker in which front and rear planar voice coils are coupled to front and rear surfaces of a planar coil plate, respectively, according to the present invention.

FIG. 20 illustrates a state where a coil plate guide means is employed as another diaphragm.

BEST MODE FOR CARRYING OUT THE INVENTION

Hereinafter, preferred embodiments of a plate type speaker with a coil plate guide means according to the present invention will be described with reference to the accompanying drawings.

FIG. 3 is an exploded perspective view of a plate type speaker according to a first embodiment of the present invention.

As shown in FIG. 3, a plate type speaker with a coil plate guide means according to the present invention comprises a concave base frame 100 with an open top portion; first and second magnetic bodies 200*a* and 200*b* coupled to the base frame 100 such that opposite polarities at upper and lower ends thereof are alternately arranged at a predetermined interval; a diaphragm 300 in the form of a flat panel with a size insertable into the base frame 100 and provided with a bonding member 310 at an outer periphery of the diaphragm to be bonded to a top portion of the base frame 100; a coil plate 400 which is in the form of a flat panel with a voice coil 410 for a current flow fixed in a longitudinal direction of spaces between the magnetic bodies 200*a* and 200*b* and is coupled to a lower end surface of the diaphragm 300 at an angle allowing the coil plate 400 to be inserted into the spaces between the magnetic bodies 200*a* and 200*b*; and a fixing member 500 spaced apart from the magnetic bodies 200*a* and 200*b* for guiding the position and vibration direction of the coil plate 400 to allow vertical vibration of the coil plate.

The respective magnetic bodies 200*a* and 200*b* comprise permanent magnets 210*a* and 210*b* with a size insertable into the base frame 100 and with opposites polarities at upper and lower ends thereof, upper plates 220*a* and 220*b* coupled to the upper ends of the permanent magnets 210*a* and 210*b*, and lower plates 230*a* and 230*b* coupled to the lower ends of the permanent magnets 210*a* and 210*b* and coupled to the bottom surface of the base frame 100. At this time, as shown in the figure, each of the magnetic bodies 200*a* and 200*b* is formed to take the shape of a comb with protrusions and depressions. The protrusions of one of the magnetic bodies are inserted into the depressions of the other thereof. At this time, it is also preferred that at least the upper and lower plates 220*a*, 220*b*, 230*a* and 230*b* of the magnetic bodies 200*a* and 200*b* be formed to take the shape of a comb.

The voice coil 410 is wound on and coupled to the coil plate 400. The coil plate 410 is inserted into the spaces between the two magnetic bodies 200*a* and 200*b* such that upper and lower ends of the voice coil 410 are positioned between the upper plates 220*a* and 220*b* and between the lower plates 230*a* and 230*b*, respectively.

Since the configuration and coupling structure of the magnetic bodies 200*a* and 200*b* and the coil plate 400 employed in the present invention are the same as a magnetic body and a coil plate employed in a conventional plate type speaker, detailed descriptions thereof will be omitted.

Further, the base frame 100 is formed with a bottom opening 120 in a portion of the bottom surface of the base frame corresponding to a lower end of the coil plate 400 so that the lower end of the coil plate 400 can be exposed outside therethrough. The fixing member 500 is made of a flexible material or formed to have a flexible structure and is coupled to the lower end of the coil plate 400 and to the bottom surface of the base frame 100. At this time, the shape of the bottom opening 120 is determined depending on a bent shape of the coil plate 400.

Accordingly, the lower end of the coil plate 400 inserted into the spaces between the first and second magnetic bodies 200*a* and 200*b* is engaged with the fixing member 500 coupled to the bottom surface of the base frame 100 so that the horizontal movement thereof is restricted. Thus, the horizontal position of the coil plate 400 employed in the present invention is not changed even though the coil plate 400 vibrates for a long time or a magnetic force generated by the magnetic bodies 200*a* and 200*b* is changed in magnitude and direction. Consequently, there is no contact of the coil plate 400 with the magnetic bodies 200*a* and 200*b*.

Further, the base frame 100 is formed with at least one side opening 110 bored through a sidewall thereof so that air flows inward or outward when the top opening of the base frame is hermetically closed by the diaphragm 300. If the side opening 110 is not formed in the base frame 100, pressure within the base frame 100 increases when the diaphragm 300, which is connected to and hermetically closes the top portion of the base frame 100, vibrates vertically. Accordingly, the diaphragm 300 cannot normally vibrate only with an electric current and a magnetic flux and is affected by the air pressure within the base frame 100. However, if the side openings 110 are formed in the base frame 100 like the embodiment shown in FIG. 3, the pressure within the base frame 100 does not vary and thus the diaphragm 300 normally vibrates only with the current and the magnetic flux.

FIG. 4 is a bottom view of the base frame to which the coil plate and the magnetic bodies shown in FIG. 3 are coupled.

As shown in FIG. 4, when the coil plate 400 and the magnetic bodies 200*a* and 200*b* are mounted to the base frame 100, the entire lower end of the coil plate 400 and some of lower portions of the first and second lower plates 230*a* and 230*b* are exposed outside through the bottom opening 120 of the base frame 100. Further, although the first and second lower plates 230*a* and 230*b* cannot vertically move since they are fixedly coupled to the base frame 100, the coil plate 400 does not interfere with the base frame 100 upon vertical movement thereof since the coil plate 400 is not coupled directly to the base frame 100.

FIG. 5 is a plan view of a fixing member shown in FIG. 3.

As shown in FIG. 5, the fixing member 500 employed in the present invention is formed with through-holes 510 in some of portions corresponding to the bottom opening of he base frame 100. At this time, the through-holes 510 are formed such that coil plate engagement portions 520 for engagement with the coil plate 400 remain in the portions corresponding to the lower end of the coil plate 400.

Since the fixing member 500 employed in the present invention is formed with the through-holes 510, it is possible to prevent changes in the pressure within the base frame 100 due to the vertical vibration of the diaphragm 300 as well as to improve flexibility of the coil plate engagement portions 520 engaged with the coil plate 400. Accordingly, the coil plate 400 can vibrate vertically without being influenced by the engagement with the fixing member 500.

FIG. 6 is a bottom view of the plate type speaker according to the first embodiment of the present invention.

If the fixing member 500 shown in FIG. 5 is coupled to the bottom surface of the base frame to which the coil plate 400 and the magnetic bodies 200*a* and 200*b* shown in FIG. 4 are mounted, some portions of the coil plate 400 and the first and second lower plates 230*a* and 230*b* are exposed outside through the through-holes 510, as shown in FIG. 6.

Although only the lower end of the coil plate 400 is engaged with the fixing member 500 in a vertical direction so that the coil plate 400 vibrates more freely in this embodiment, the position and range of the engagement between the coil plate 400 and the fixing member 500 are not limited thereto but may be changed variously.

FIG. 7 is a sectional view of the plate type speaker, taken along line A-A of FIG. 6.

As shown in FIG. 7, the coil plate 400 with the voice coil 410 coupled thereto is coupled to the fixing member 500 in such a manner that the coil plate 400 is kept in non-contact with either the first magnetic body 200*a* or the second magnetic body 200*b*.

Accordingly, the use of the plate type speaker with the coil plate guide means according to the present invention prevents the coil plate 400 from being in contact with the magnetic bodies 200*a* and 200*b* due to deformation of the long-term used coil plate 400, thereby prolonging the life of the speaker as well as avoiding degradation of the quality of output sound.

Further, the base frame 100 has downwardly protruding base projections 130 formed at the bottom surface thereof. The formation of the base protrusions 130 prevents the bottom opening 120 from coming into contact with a floor and also prevents the coil plate 400 from coming into contact with a floor upon vertical vibration of the coil plate. Accordingly, the coil plate 400 can normally vibrate and the diaphragm 300 can output normal sound.

FIG. 8 illustrates a state where a voice coil is coupled to front and rear surfaces of a coil plate, and FIG. 9 is a sectional view taken along line B-B of FIG. 8.

If it is intended to enlarge a cross sectional area of the coil coupled to the coil plate 400 so as to increase a force applied to the coil plate 400, the voice coil 410 can be coupled to both sides of the coil plate 400, as shown in FIGS. 8 and 9.

In the case where the voice coil 410 is coupled to the both sides of the coil plate 400, the coil plate 400 has a connection hole 402 bored through the coil plate 400 at a central portion thereof, and the voice coil 410 is wound on and coupled to one side of the coil plate 400 and then is successively wound on and coupled to the other side of the coil plate 400 after passing through the connection hole 402. At this time, even though the coupling position of the voice coil 410 is changed from one side of the coil plate 400 to the both sides of the coil plate 400, the winding direction of the voice coil 410 is equally maintained. Accordingly, a force generated by the magnetic flux from the magnetic body 200 and the electric current flowing through the voice coil 410 and applied to the coil plate 400 is not changed in its direction.

FIG. 10 illustrates a state where front and rear voice coils are coupled to front and rear surfaces of a coil plate, respectively, and FIG. 11 is a sectional view taken along line C-C of FIG. 10.

As shown in FIGS. 10 and 11, in a case where a voice coil 410, which will be coupled to the both sides of the coil plate 400, is divided into two parts and then coupled to the both sides, the voice coil 410 comprises a front voice coil 412 wound on and coupled to the front surface of the coil plate 400, and a rear voice coil 414 wound on and coupled to the rear surface of the coil plate 400.

In addition, the coil plate 400 further comprises a connection hole 402 formed to be bored through a central portion thereof, and a connection means 404 for electrically connecting the front and rear voice coils 412 and 414 to each other through the connection hole 402.

At this time, the connection means 404 for connecting the front and rear voice coils 412 and 414 to each other through the connection hole 402 is employed as a conductor that comes into contact with the front and rear voice coils 412 and 414. Further, as for methods for connecting the front and rear voice coils 412 and 414 to each other, various connection methods including welding and soldering can be employed so far as they allow an electric current to flow through the front and rear voice coils 412 and 414.

FIG. 12 is a sectional view of a plate type speaker with front and rear voice coils coupled to front and rear surfaces of a coil plate, respectively, according to the present invention.

When the front and rear voice coils 412 and 414 are coupled to the front and rear surfaces of the coil plate 400, respectively, as shown in FIG. 12, the cross sectional area of the voice coil 410 is increased twice as large as that of the plate type speaker shown in FIG. 7. Accordingly, the force for upwardly moving the coil plate 400 is also increased.

Further, even though the structure of the voice coil 410 coupled to the voice coil plate 400 is changed, the shapes and coupling structures of the magnetic bodies 200 and the diaphragm 300 coupled to the base frame 100 are the same as the plate type speaker shown in FIG. 3.

FIG. 13 is an exploded perspective view of a plate type speaker according to a second embodiment of the present invention.

The second embodiment corresponds to an embodiment in which a fixing member 500' is applied to 'a plate type speaker with a plurality of coil plates' filed in the name of this applicant. This embodiment employs planar magnetic bodies 200', planar coil plates 400' and a planar fixing member 500', which are different in shape from the magnetic bodies 200, the coil plate 400 and the fixing member 500 employed in the first embodiment.

Each of the planar magnetic bodies 200' employed in the second embodiment is constructed such that upper and lower planar plates 220' and 230' are coupled to upper and lower ends of a bar-shaped planar permanent magnet 210', respectively. The planar magnetic bodies 200' are coupled to the base frame 100 at a predetermined interval such that the opposite polarities of the upper planar plates 220' and the lower planar plates 230' of the magnetic bodies alternately appear.

Further, the planar coil plates 400' are separately constructed to be inserted into spaces between the planar magnetic bodies 200'. Planar voice coils 410' are wound on and coupled to the planar coil plates 400'. At this time, the planar coil plates 400' are inserted into the spaces between the planar magnetic bodies 200' such that upper and lower ends of the planar voice coils 410' are positioned between the upper planar plates 220' and between the lower planar plates 230', respectively.

Accordingly, bottom planar openings 120' employed in the second embodiment are formed to take the shape of a bar such that lower ends of the planar coil plates 400' are exposed beyond the bottom surface of the base frame. Planar through-holes 510' and planar coil plate engagement portions 520' of a planar fixing member 500' are formed to take the shape of bars as well.

Since the planar fixing member 500' employed in the second embodiment is different from the fixing member 500 employed in the first embodiment only in view of their shapes but has the same function and role as the fixing member 500 employed in the first embodiment, a detailed description thereof will be omitted.

FIG. 14 is a bottom view of the base frame to which the coil plates and the magnetic bodies shown in FIG. 13 are coupled.

If the planar coil plates 400' and the planar magnetic bodies 200' are mounted to the base frame 100, the entire lower ends of the planar coil plates 400' and some portions of bottom surfaces of the lower planar plates 230' are exposed outside through the bottom planar openings 120' of the base frame 100. Although the lower planar plates 230' cannot vertically move since they are fixedly coupled to the base frame 100, the coil plates 400' do not interfere with the base frame 100 upon vertical movement thereof since the coil plate 400' are not coupled directly to the base frame 100.

FIG. 15 is a plan view of the fixing member shown in FIG. 13.

Similarly to the first embodiment, the planar fixing member 500' employed in the second embodiment also has planar through-holes 510' formed in portions thereof corresponding to the bottom planar openings 120', and planar coil plate engagement portions 520' formed in portions thereof corresponding to the lower ends of the planar coil plates 400'.

At this time, since the bottom planar openings 120' and the planar coil plates 400' are formed to take the shape of rectangles, the planar through-holes 510' and the planar coil plate engagement portions 520' are also formed to take the shape of rectangles.

FIG. 16 is a bottom view of the plate type speaker according to the second embodiment of the present invention.

When the planar fixing member 500' shown in FIG. 15 is coupled to the bottom surface of the base frame 100 to which the planar coil plates 400' and the planar magnetic bodies 200' shown in FIG. 14 are mounted, some portions of the bottom surfaces of the lower planar plates 230' are exposed outside through the planar through-holes 510', and the planar coil plates 400' are not exposed outside since the entire lower ends thereof are bonded to the planar fixing member 500', as shown in FIG. 16.

In this embodiment, although the planar fixing member 500' is coupled to the entire lower ends of the planar coil plates 400', the position and range of the engagement between the planar coil plates 400' and the planar fixing member 500' is not limited thereto but may be changed variously.

FIG. 17 is a sectional view of the plate type speaker, taken along line B-B of FIG. 16.

As shown in FIG. 17, since the planar coil plates 400' with the planar voice coils 410' coupled thereto are coupled to the planar fixing member 500' such that the planar coil plates 400' are kept in non-contact with the planar magnetic bodies 200', the planar coil plates 400' do not come into contact with the planar magnetic bodies 200'.

Further, since the planar coil plates 400' employed in the second embodiment can be individually flexed laterally contrary to the coil plate 400 employed in the first embodiment, it is more important to have the planar fixing member 500'.

FIG. 18 illustrates an application of a corrugated fixing member.

The planar fixing member 500' employed in the present invention may be formed to be corrugated such that ridges and troughs extend along the longitudinal direction of the lower ends of the planar coil plates 400'. If the planar fixing member 500' is corrugated, horizontal elongation thereof is improved so that the planar coil plates 400' can vibrate without being greatly affected by a fixing force of the fixing member 500'.

FIG. 19 is a sectional view of a plate type speaker in which front and rear planar voice coils are coupled to front and rear surfaces of a planar coil plate, respectively, according to the present invention.

As shown in FIG. 19, each of the planar coil plates 400' may be configured to have the planar voice coil 410' coupled to the front and rear surfaces of the planar coil plate 400'.

Since the coupling structure of the planar voice coil 410' to the front and rear surfaces of each of the planar coil plates 400' is the same as the coupling structure of the voice coil 410 to the coil plate 400 shown in FIGS. 8 to 12, a detailed description thereof will be omitted.

Further, if the vibration of the planar coil plate 400' does not affect changes in the pressure within the base frame 100, the fixing member 500' may be configured as shown in FIG. 19 such that it does not have the planar through-holes 510' (See FIG. 18).

FIG. 20 illustrates a state where a coil plate guide means is employed as another diaphragm.

When the coil plate guide means employed in the present invention is employed as another diaphragm, the top and bottom portions of the base frame 100 are formed to be open, and the respective diaphragms 300 are coupled to the upper and lower ends of the coil plates 400', so that the plate type speaker is symmetrical with respect to a centerline thereof, as shown in FIG. 20.

When the diaphragms 300 are coupled to the top and bottom portions of the base frame 100, the pair of diaphragms 300 coupled to the top and bottom portions of the base frame 100 serve to guide the vibration direction of the coil plates 400' and simultaneously to output sound upward and downward from the base frame 100, respectively.

The structure in which the coil plate guide means is employed as another diaphragm 300 is applicable to various embodiments irrespective of the shape of the coil plates 400'.

Although the present invention has been described in detail in connection with the preferred embodiments, the scope of the present invention is not limited to the specific embodiments but should be construed based on the appended claims. Further, it will be understood by those skilled in the art that various modifications and changes can be made without departing from the scope of the present invention.

For example, the plate type speaker of the present invention may include only one magnetic body. In this case, the magnetic body may be constructed in various manners such that two different polarities of the magnetic body face each other with a predetermined gap therebetween. At this time, contrary to the illustrated embodiments, the polarities of the magnetic body are horizontally arranged only in a single row. Further, only a portion of the voice coil plate, which corresponds to one of two ends of the voice coil plate where the voice coil is horizontally formed, may be inserted between the facing opposite polarities of the magnetic body.

INDUSTRIAL APPLICABILITY

The use of the plate type speaker with the coil plate guide means according to the present invention allows the position of a coil plate to be guided so that the coil plate does not come into contact with a permanent magnet or upper and lower plates even though the coil plate vibrates vertically, thereby preventing output of abnormal sound due to interference of the coil plate with the internal parts.

Further, in the plate type speaker with the coil plate guide means according to the present invention, there is an advantage in that the internal parts do not come into contact with one another, resulting in prolonged life of the plate type speaker.

The invention claimed is:

1. A plate type speaker, comprising:

a base frame;

at least one magnetic body coupled to the base frame such that opposite polarities are provided at adjacent lateral positions and are spaced apart by a predetermined distance from each other;

a diaphragm;

at least one coil plate formed with a voice coil wound on either or both of sides thereof, said coil plate being inserted vertically into spaces between the opposite polarities of the magnetic body and connected to the diaphragm; and a coil plate guide means coupled to the coil plate for guiding the position and vibration direction of the coil plate such that the coil plate is spaced from the magnetic bodies and vibrates vertically, wherein the base frame has at least one opening formed in at least a portion of a bottom surface thereof corresponding to a lower end of the coil plate so that the lower end of the coil plate passes through the bottom surface of the base frame, and the coil plate guide means comprises a fixing member formed to be flexible and coupled to the lower end of the coil plate and to the bottom surface of the base frame, wherein the fixing member is formed with through-holes.

2. The plate type speaker as claimed in claim 1, wherein the base frame is configured to have open top and bottom portions, the diaphragm is coupled to an upper end of the coil plate, and the coil plate guide means is coupled to a lower end of the coil plate to function as another diaphragm.

3. The plate type speaker as claimed in claim 1, wherein the fixing member is corrugated to have ridges and troughs along a longitudinal direction of the coil plate.

4. The plate type speaker as claimed in claim 1, wherein a plurality of the magnetic bodies with opposite polarities at upper and lower ends thereof are spaced apart by a predetermined distance from one another.

5. The plate type speaker as claimed in claims 4, wherein each of the magnetic bodies comprises:

a permanent magnet with opposite polarities at upper and lower ends thereof;

an upper plate connected to the upper end of the permanent magnet; and a lower plate connected to the lower end of the permanent magnet and connected to a bottom surface of the base frame.

6. The plate type speaker as claimed in claim 4, wherein both opposite ends of the voice coil wound on either or both of the sides of the coil plate are positioned at levels of the upper and lower ends of the magnetic bodies, respectively.

7. The plate type speaker as claimed in claim 1, wherein the base frame is formed with at least one opening bored through a wall surface thereof.

8. The plate type speaker as claimed in claim 1, wherein said at least one magnetic body is formed to take the shape of a comb such that respective portions of the magnetic body with the opposite polarities have protrusions and depressions in a horizontal direction, the protrusions are inserted into the respective depressions with a predetermined gap therebetween, and the coil plate is formed to take the shape of a plate bent such that it can be vertically inserted into the spaces.

9. The plate type speaker as claimed in claim 1, a plurality of coil plates in the form of a flat panel are arranged in parallel.

* * * * *